United States Patent [19]

Hall

[11] Patent Number: 4,640,405

[45] Date of Patent: Feb. 3, 1987

[54] COIN CHUTE CONSTRUCTION AND METHOD OF MAKING SAME

[75] Inventor: Mitchell A. Hall, Ft. Thomas, Ky.

[73] Assignee: Monarch Tool & Manufacturing Company, Covington, Ky.

[21] Appl. No.: 623,574

[22] Filed: Jun. 22, 1984

[51] Int. Cl.[4] ..... G07F 5/06

[52] U.S. Cl. ..... 194/235; 194/349

[58] Field of Search ..... 194/1 G, 55, 92, 93, 194/102, DIG. 2, DIG. 7, 1 D, 1 E, 235, 349

[56] References Cited

U.S. PATENT DOCUMENTS

| | | | |
|---|---|---|---|
| 1,524,703 | 2/1925 | Fogelsonger | 194/DIG. 7 |
| 1,753,197 | 4/1930 | Beddard | 194/102 |
| 2,116,309 | 5/1938 | Gorton | 194/55 X |
| 3,732,962 | 5/1973 | Hall | 194/92 |
| 4,350,240 | 9/1982 | Gitlin et al. | 194/92 |
| 4,502,584 | 3/1985 | Lambiris | 194/1 G |

*Primary Examiner*—F. J. Bartuska

*Attorney, Agent, or Firm*—Kinney & Schenk

[57] ABSTRACT

A coin chute construction for a dispensing machine and method of making same are provided wherein such machine requires at least one coin of predetermined size and valuation to initiate one operation of the machine for one item of goods or service. The construction comprises cooperating structural components for providing movement of the coin away from and then back toward a rectilinear path during movement of a slider of the construction which carries such coin from an inoperative position to a test position for the coin prior to initiation of the one operation of the machine.

29 Claims, 13 Drawing Figures

8
52

9
152
50
10
122
64
64
117
130
125
126
110
130
34
73
131
105
105
72
72
73
37
37
151
150
152
22
158
152
147
9
8
10
159
146
153

117
36

135
133
142
35
140
34
153
156
158
47
159

117

135
133
143
36
35
140
34
157
153
47
159
158

135
144
34
36
35
140
133

COIN CHUTE CONSTRUCTION AND METHOD OF MAKING SAME

BACKGROUND OF THE INVENTION

1. Field of the Invention

This invention relates to a coin chute construction and more particularly to such a construction for a dispensing machine which requires at least one coin of predetermined size and valuation to initiate one operation of such machine for one item of goods or service.

2. Prior Art Statement

It is known in the art to provide a construction which is referred to by various names including coin slide, coin-control operator, or coin chute construction and which is used to initiate one operation of a dispensing machine such as a dispensing machine which dispenses food, drink, or a commodity such as washing clothes or drying clothes, or the like. However, coin chute constructions proposed heretofore have deficiencies in that they can often be "cheated", i.e., flat elongate shims, slugs, or illegal coin shaped articles may be used to cause the machine to initiate one operation thereof. In addition the construction is often comparatively easily jammed preventing normal operation thereof.

One example of a known coin chute construction which overcomes some of the above-mentioned deficiencies is disclosed in applicant's U.S. Pat. No. 3,732,962 and the known construction comprises, a support body, a slider supported on the body for reciprocation in a rectilinear path between a fully retracted inoperative position and a fully advanced operative position thereof, at least one pocket in the slider for receiving a coin with pocket being defined by surface means for supporting the coin so that upon moving the slider toward the operative position the coin is moved therewith to a test position and then toward the operative position. Such a construction also has test means at the test position for testing the coin for acceptability as to valuation and genuineness and when acceptable allowing full movement of the slider to the operative position enabling the slider to initiate the one operation of the machine, and the construction also has means operative upon failure of the coin to satisfy the test provided by the test means at the test position to thereby preclude the full movement to the operative position of such construction.

SUMMARY OF THE INVENTION

This invention provides an improved coin chute construction for a dispensing machine which requires at least one coin of predetermined size and valuation to initiate one operation of the machine for one item of goods or service and the construction comprises a support body, a slider supported on the support body for reciprocation in a rectilinear path between a fully retracted inoperative position and fully advanced operative position thereof, at least one pocket in the slider for receiving the coin, with the pocket being defined by surface means for supporting the coin so that upon moving the slider toward the operative position the coin is moved therewith to a test position and then toward the operative position. The construction also includes test means at the test position for testing the coin for acceptability as to valuation and genuineness and when acceptable allowing full movement of the slider to the operative position enabling the slider to initiate the one operation of the machine, and the construction has means operative upon failure of the coin to satisfy the test provided by the test means at the test position to preclude the full movement to the operative position.

In accordance with one embodiment of this invention the construction has means for providing movement of the coin away from and then back toward the rectilinear path during movement of the slider from its inoperative position to the above-mentioned test position.

In accordance with another embodiment of this invention the coin chute construction may be provided with removable clips to accommodate coins of different denomination.

In accordance with another embodiment of this invention a coin chute construction is provided which utilizes a barrier shield having an undulating surface.

In accordance with another embodiment of this invention a coin chute construction is provided which employs adjustable bar means in its slider to blank out or adjust the size of coin opening means therein.

In accordance with another embodiment of this invention a coin chute construction is provided which has a slider provided with a unique coin ejector.

Accordingly, it is an object of this invention to provide an improved coin chute construction of the character mentioned.

Another object of this invention is to provide an improved method of making a coin chute construction of the character mentioned.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention, in which.

DETAILED DESCRIPTION

Figure 1:
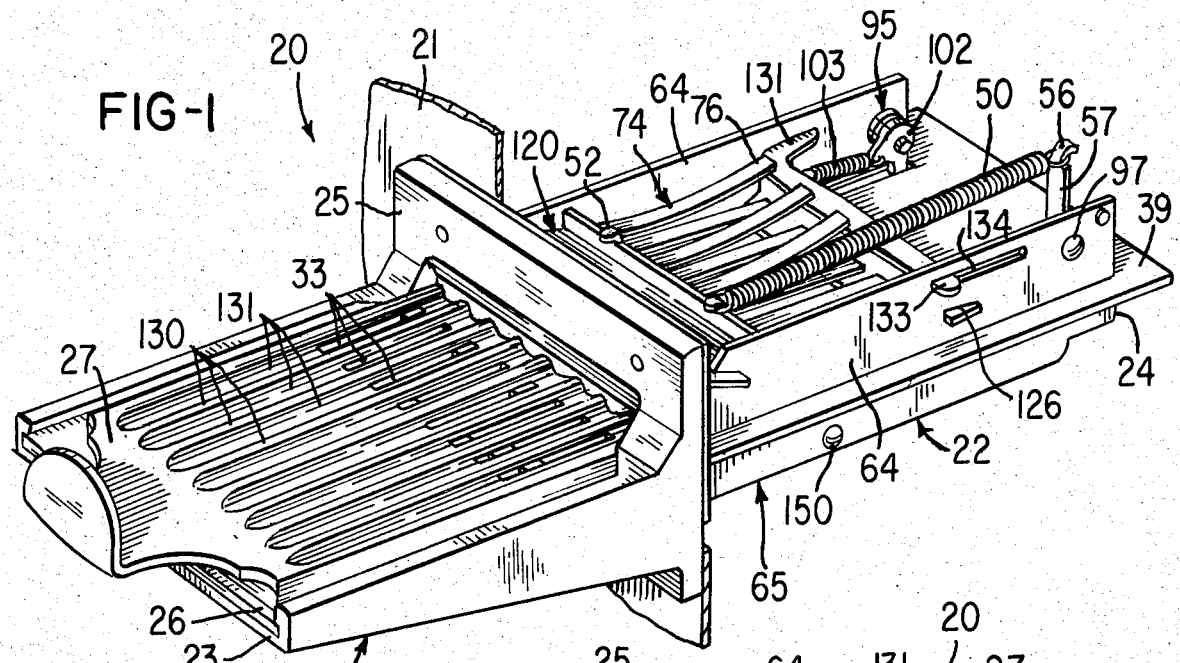
FIG. 1 is an isometric view illustrating one exemplary embodiment of the coin chute construction of this invention.

Reference is now made to FIG. 1 of the drawings which illustrates one exemplary embodiment of a coin chute construction of this invention which is designated generally by the reference numeral 20 and such construction is provided for an exemplary dispensing machine 21 and a fragmentary portion of such machine is illustrated in FIG. 1. The machine 21 may be of any suitable type known in the art in which a coin chute construction is utilized and may be in the form of a food or drink dispensing machine; or in the form of a commodity dispensing machine, such as, a clothes washer or dryer; or like machine. The machine 21 requires at least one coin of predetermined size and valuation to initiate one operation of such machine for one item of goods or service.

As seen in FIG. 1 of the drawings the coin chute construction 20 comprises a support body which is designated generally by the reference numeral 22 and the body 22 has opposite ends 23 and 24, a mounting plate 25, and a top face 26 defining runway means for a purpose to be subsequently described. The construction 20 also comprises a slider 27 supported on the top face 26 of the support body 22 for reciprocation in a rectilinear path P between a fully retracted inoperative position, shown at 30 in FIG. 3, and a fully advanced operative position, shown at 31 in FIG. 6.

Figure 2:
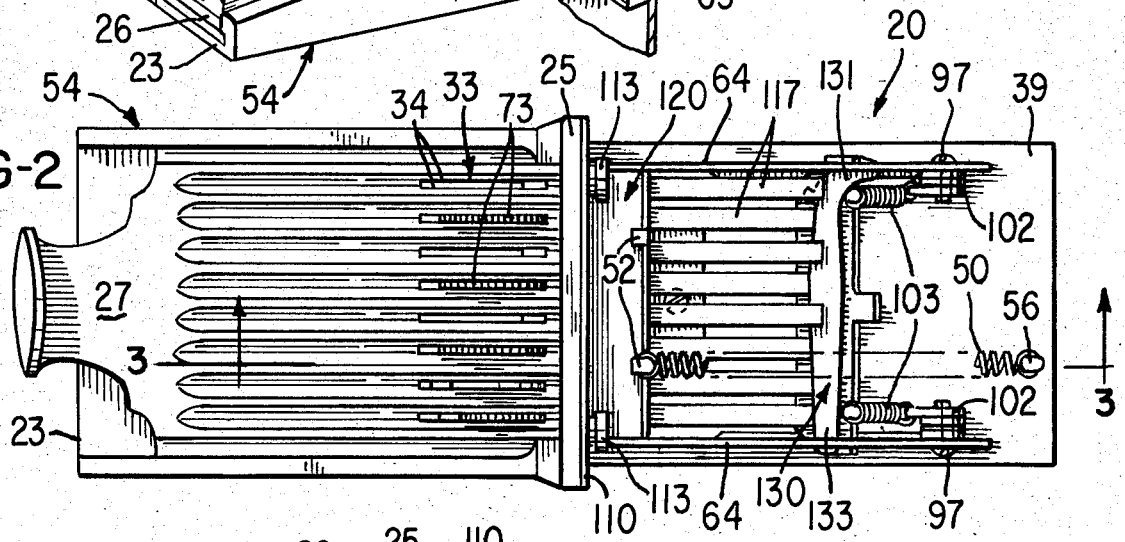
FIG. 2 is a top plan view of the coin chute construction of FIG. 1.

The slider 27 has at least one narrow elongate pocket therein; and, in this exemplary embodiment of the invention the slider has a plurality of eight pockets each designated by the reference numeral 33 and with only a few representative ones of such pockets being so designated. Each pocket 33 is provided in the slider 27 near the forward end thereof and for receiving an associated coin. Each pocket 33 is defined by surface means for supporting its associated coin in an edgewise manner and in this example of the invention such surface means and hence each pocket 33 is defined by a pair of side surfaces 34 in the slider (FIG. 2) and end surface means comprising an end surface portion 35 (FIG. 3) of slider 27 and an end surface portion 36 of an associated adjustable bar 37 of a plurality of such bars 37 comprising the slider 27 and the bars 37 will be subsequently described.

Figure 5:
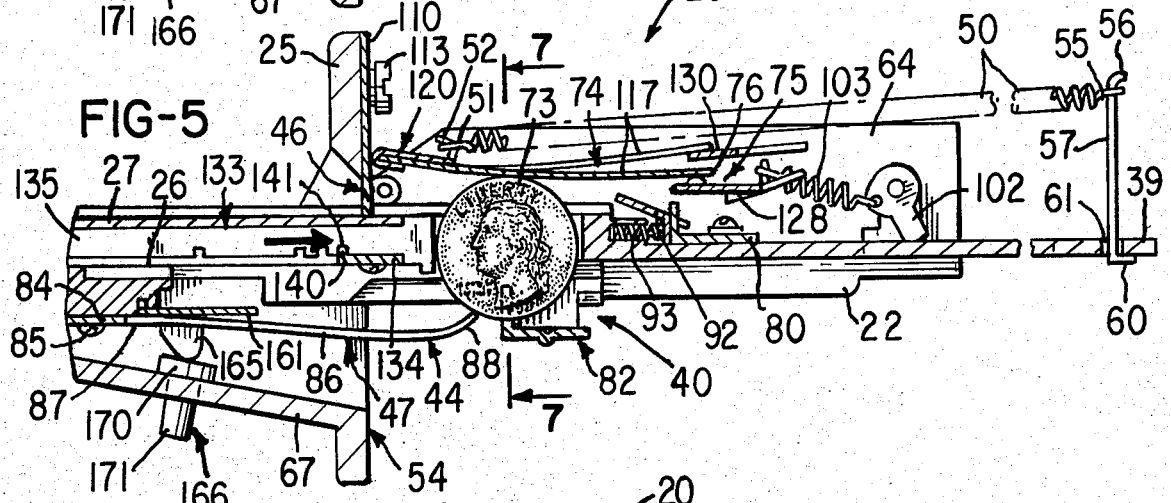
FIG. 5 is a view similar to FIG. 4 illustrating the coin in its test position for testing such coin for acceptability as to its valuation and genuineness.

The surface means defining each pocket supports each coin associated therewith so that upon moving the slider toward its operative position the coin is moved therewith to a test position shown at 40 in FIG. 5 and then to its fully advanced operative position 31. At position 31 each coin falls into the coin box and the end 39 of the slider actuates a suitable mechanism which is shown in this example as a depressable plunger 41 of a switch mechanism 42.

The construction 20 has test means at the test position 40 and such test means may be of any suitable type known in the art and will be described in more detail subsequently. The test means serves to test each coin in an associated pocket for acceptability as to valuation and genuineness and when acceptable the test means allows full movement of the slider 27 to the advanced operative position 31 whereby the plunger 41 is actuated causing the switch mechanism 42 to initiate one operation of the machine 21. The operation of the plunger 41, switch mechanism 42, and associated electrical and electromechanical components of the machine 21 are well known in the art and thus will not be described herein. The construction 20 also has means operative upon failure of one or more coins to satisfy the test provided by the test means at the test position 40 to preclude movement of the slider 27 to the advanced operative position 31.

Figure 3:
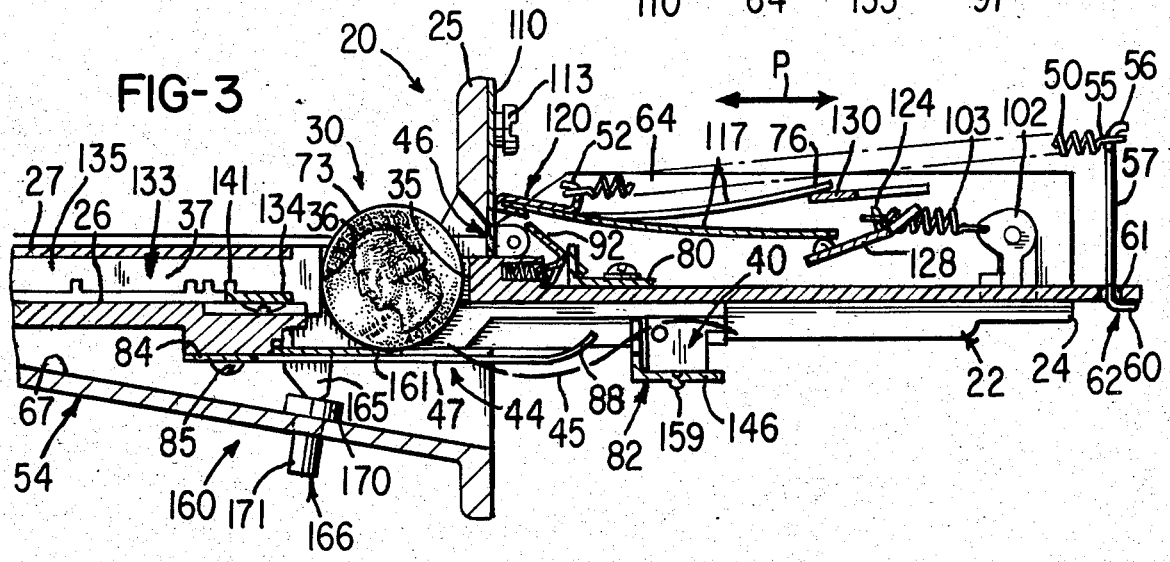
FIG. 3 is a cross-sectional view taken essentially on the line 3—3 of FIG. 2 and illustrating a coin inserted in an associated pocket of a slider of the coin chute construction and with slider in its fully retracted inoperative position.
Figure 4:
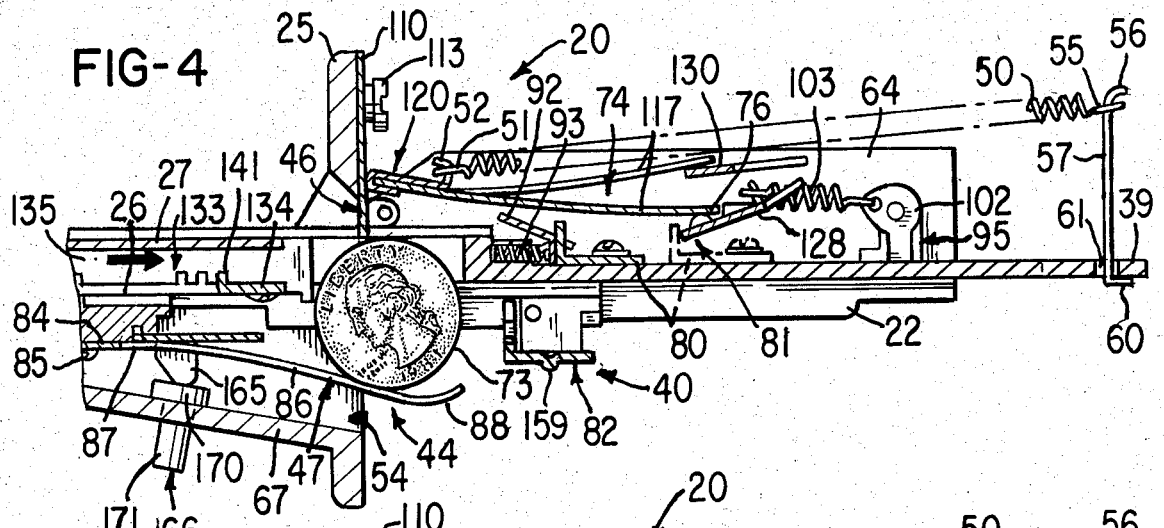
FIG. 4 is a view similar to FIG. 3 illustrating movement of the slider and coin toward its advanced operative position and with a coin disposed vertically under a baffle comprising baffle means of the coin chute construction.

In accordance with the teachings of this invention the construction 20 has means for providing movement of each coin away from and then back toward the previously mentioned rectilinear path P of the slider 27 during movement of the slider 27 from its inoperative position at 30 to the test position at 40; and, such providing means is illustrated in FIG. 4, for example, and designated generally by the reference numeral 44. The providing means 44 provides the above-mentioned movement of each coin away from and then back toward the rectilinear path P as a curvilinear movement and such curvilinear movement is shown by dotted lines in FIG. 3 of the drawings and designated by the reference numeral 45.

The providing means 44 comprises baffle means designated generally by the reference numeral 46 and cooperating yieldable spring means 47. In accordance with the teachings of this invention the providing means 44 and the curvilinear movement 45 cooperate to prevent shims or like objects from being used effectively to bypass the function of the test means at the test position 40. In addition, the providing means 44 also provides a self-cleaning action for foreign objects such as gum, toothpicks, putty-like materials, and the like from being urged against an outer surface of the slider 27 to thereby reduce the likelihood of jamming of the slider during the reciprocation thereof.

The construction 20 also has means for returning the slider from its fully advanced operative position 31 illustrated in FIG. 6 to its fully retracted inoperative position shown at 30 in FIG. 3 and such means comprises a spring 50 in the form of a tension spring which has one end 51 thereof attached to a hooking member 52 which is detachably fastened to side plates 64 which are supported by the mounting plate 25 as will be described subsequently.

The opposite end of the spring 50 has a looping end 55 which is in turn detachably fastened to a hooking portion 56 of a member 57 which is carried by the inner end of the slider 27. The member 57 has a hooking end 60 which extends through an opening 61 in the inner end of the slider 27 and is hooked in position as shown at 62 in FIG. 3. Thus, the spring 50 serves to retract the slider once the slider is moved from its fully retracted inoperative position shown at 30 in FIG. 3 to its fully advanced operative position shown at 31 in FIG. 6.

Figure 13:
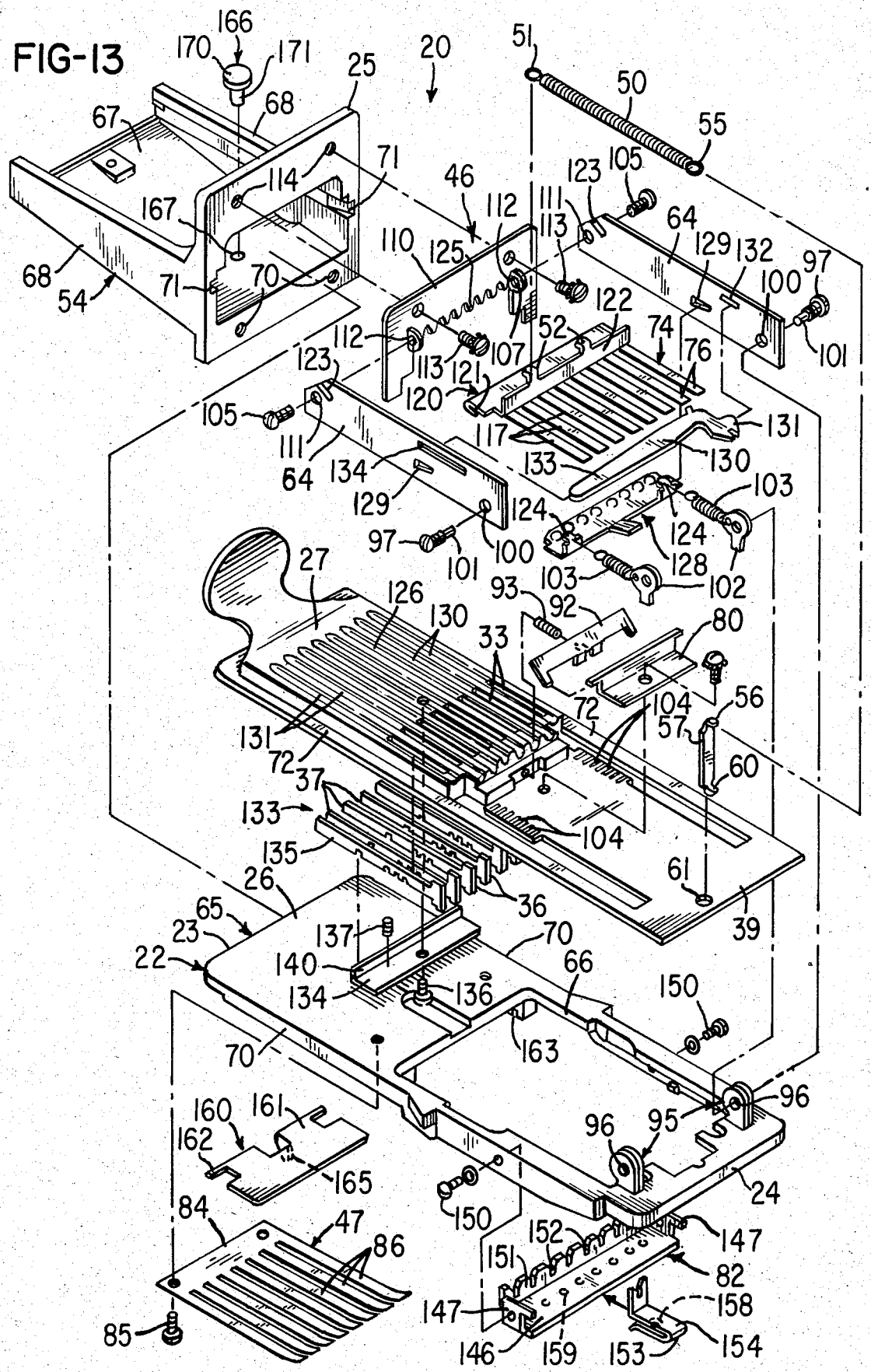
FIG. 13 is an exploded isometric view illustrating the various components of the coin chute construction of this invention.

As will be readily apparent from FIG. 13 of the drawings, the support body 22 is basically comprised of a plurality of two main parts and such main parts include a forward supporting portion 54 and an inwardly extending portion 65 which is provided with a comparatively large rectangular cutout 66 therein which receives coins from the slider once such coins have been found acceptable as to valuation and genuineness at the test position 40. The supporting portion 54 has a bottom wall 67 and a pair of side walls 68. The mounting plate 25 of the construction 20 is formed at the forward end of the walls 67 and 68 and as an integral single-piece structure therewith. The mounting plate has a plurality of two bottom threaded openings 70 for mounting same to the machine 21. The portion 65 has opposite side edges 70 suitably received and fixed in position in corresponding slots 71 in portion 54 and the upper parts of slots 71 also receive side edges 72 of the slider 27 and allow unobstructed movement of such slider along path P.

As previously mentioned the construction 20 has providing means 44 which provide the curvilinear movement 45 which is illustrated by dotted lines in FIG. 3. The curvilinear movement makes it exceedingly difficult to insert thin elongate objects such as shims, toothpicks, and like items into the construction 20 to cheat same and cause operation of the machine 21 on which the construction 20 is used.

Figure 6:
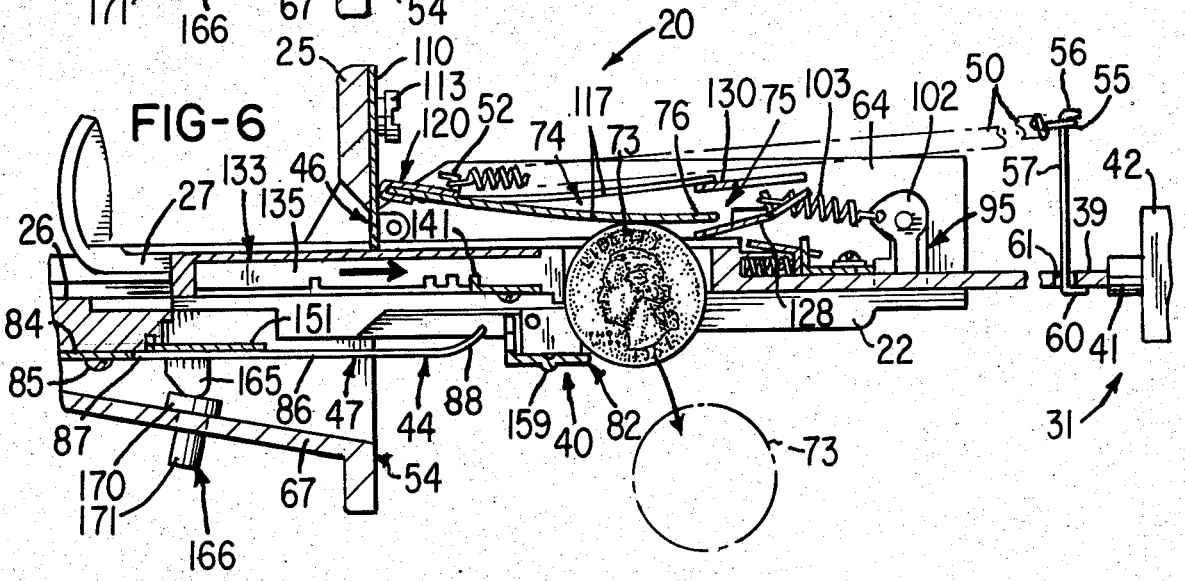
FIG. 6 is a view similar to FIG. 5 and illustrating the slider in its fully advanced operative position and with the now tested and accepted coin in position to drop in a coin box.
Figure 7:
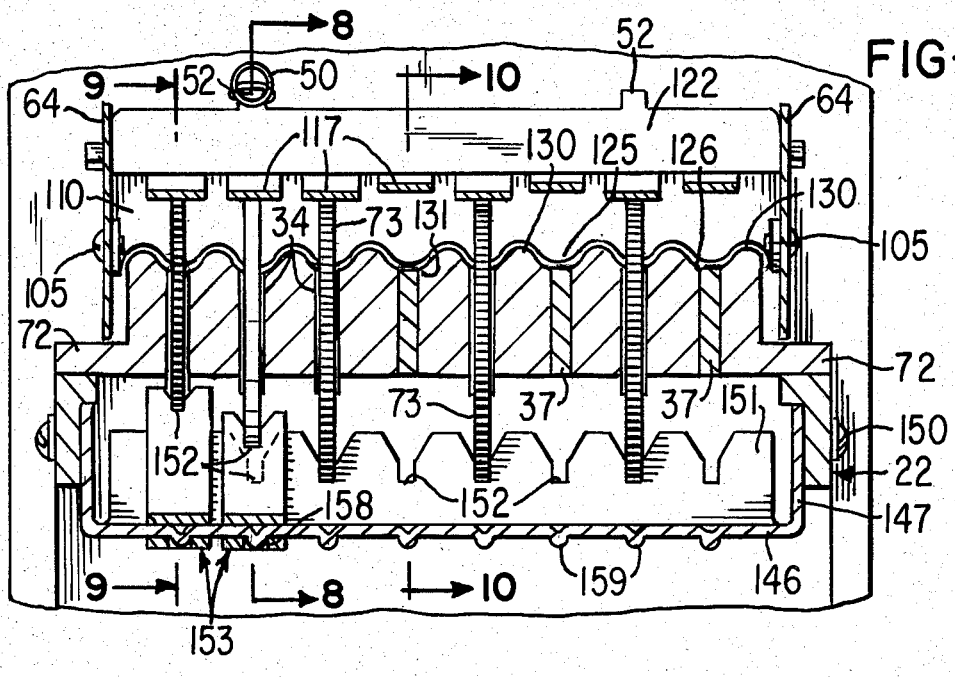
FIG. 7 is an enlarged fragmentary view taken essentially on the line 7—7 of FIG. 5.

However, in the normal operation of the construction 20 when a coin such as a United States twenty-five cent coin 73 is introduced into the construction (FIG. 3) and such coin 73 is moved into the test position 40, as shown in FIG. 5, and found acceptable, the operation of the construction 20 is such that an upper leaf spring structure 74 thereof has its inner end released as shown at 75 allowing the coin to be moved through the test position 40 and the slider to be moved to its fully advanced operative position shown at 31 in FIG. 6 whereby the switch mechanism 42 is actuated and causes the machine 21 to provide its dispensing function. If the coin 73 is found unacceptable as to genuineness and valuation the upper leaf spring structure 74 will not be released as shown at 75 and the coin 73 and slider 27 cannot be advanced.

It will be noted in FIG. 4 that prior to introduction of the coin into the test position 40 the inner end 76 of the leaf spring structure 74 is disposed downwardly in such a position that it engages a pivoted strip 128 whereby an L-shaped stop member 80 carried by the slider 27 engages the forward end thereof as shown at 81 preventing full advancing movement of the slider 27 to its fully advanced operative position 31.

Each coin which is inserted in the construction 20 is gauged between what will be referred to interchangeably as a gauge bar or gauge bar structure 82, as shown in FIGS. 4 and 13, and the upper leaf spring structure 74. Thus, as each coin is inserted in its pocket 33 in the slider 27 and moved from the inoperative position of the slider to the fully advanced operative position of such slider the coin is initially supported on yieldable spring means 47 previously described. The spring means 47 serves to support each coin inwardly of a plane defining the inside surface of the slider; and, in this example of the invention with the movement of the slider being horizontal, the yieldable spring means 47 supports each coin in a vertical direction. The yieldable spring means 47 provides for movement of each coin into the test position 40; and, such spring means 47 is in the form of a comb-like leaf spring structure 47 (FIG. 5) having one end 84 thereof fastened to the support body 22 and in particular to portion 65 of such support body by threaded screws 85, also see FIG. 13, whereby the spring means or spring structure 47 is fastened in a cantilevered manner. The spring structure has a plurality of spaced parallel members 86 each adapted to support a coin and each having a straight upstream portion 87 provided with an integral bridging part holding same together and defining the end 84 of structure 47. Each member 86 has an upwardly curved downstream portion 88 which is adapted to introduce its associated coin into the test means at the test position 40. Each coin is gauged between the gauge bar 82 and the upper leaf spring structure 74 whereby each coin is, in essence, gauged in a common plane disposed above the coin.

In this manner each advancing coin is disposed between the gauge bar 82 and the upper leaf spring structure 74 to a common level so that the top edges thereof are in the above-mentioned common plane which enables the determination of the valuation and genuineness of each coin with great precision. It will also be appreciated that by providing the gauging function such that, in essence, it is controlled at the top of each coin as the coin is advanced through the construction 20, the likelihood of being able to cheat the machine by inserting thin elongate objects, or the like, in the construction 20 is very small. It will be appreciated that the testing of the coins at the test position 40 by moving the coins so that the top edges thereof are in a common plane is essentially as taught in the above-referenced U.S. Pat. No. 3,732,962 and the applicable portions of such patent on this point and indeed the entire disclosure of this patent is incorporated herein by reference thereto. The above-mentioned patent teaches other features that prevent cheating and the introduction of slugs or other fake coins into a chute construction and the teachings of this patent are fully applicable to the coin chute construction 20.

After a coin or slug is introduced into the construction 20 and moved to the position shown in FIG. 4 the construction is in such a position that a skilled thief might attempt to insert a thin elongate object such as a shim, or the like, into the construction 20 in an effort to release the inner end 76 of the upper leaf spring structure 74 and allow advancement of the slider 27 without using the coin. To preclude this possibility it will be seen that a baffle 92 (see FIGS. 4 and 13) is pivotally detachably positioned forward of the stop 80. The baffle is yieldingly held with its forward end or portion urged upwardly by a compression spring 93 acting between the inner end of such baffle and a portion of the slider 27. The raised forward portion of the baffle 92 makes it virtually impossible to insert a thin elongate object, or the like, past the baffle 92 to cause release of the inner end 76 of the upper leaf spring structure 74.

The portion 65 of the support body 22 has a support lug structure in the inner end thereof and each lug structure is designated generally by reference numeral 95, as shown in FIG. 13. Each support lug structure or lug is a double thickness lug and has an opening 96 provided therein with the openings 96 being disposed on an axis which is disposed substantially perpendicular to the path of movement of the slider 27. Each lug 95 is adapted to have an associated side plate 64 suitably threadedly fastened thereto by a special screw 97 which will now be described.

Each screw 97 extends through an associated opening 100 in the inner end of its side plate 64 and a threaded portion of each screw 97 is adapted to engage cooperating threads defining the opening 96 to thereby fix the inner end of the side plate 64 against its associated lug 95. Each special screw 97 also has a smooth shaft portion 101 which extends inwardly beyond the inside surface of its associated side plate 64 and is adapted to pivotally support an associated pawl 102, which will now be described.

Each pawl 102 is biased by an associated tension spring 103 into engagement with a set of associated spaced parallel teeth 104 on the slider 27. The teeth 104 and pawl 102 define a pawl and ratchet arrangement of a type known in the prior art and as referred to in the above-mentioned U.S. Pat. No. 3,732,962. The function of the pawl and ratchet arrangement is well known in the art and assures unidirectional progressive full advancement of the slider to the operative position following a favorable coin test. This arrangement avoids artful manipulation of the slider 27 in an effort to obtain illicit operation of the machine with which the construction 20 is associated. Because such a pawl and ratchet arrangement is well known in the art it will not be further described herein.

As best seen in FIG. 13, each side plate 64 is fastened in position at its forward end, i.e., the end adjacent the mounting plate 25, by an associated threaded screw 105. Each threaded screw is threadedly received within lugs 107 of a unique baffle 110 which comprises the baffle means 46 and baffle 110 will be described subsequently. The lugs 107 have threaded openings 112 therein which are particularly adapted to receive an associated threaded screw and each threaded screw 105 extends through an associated opening 111 in a side plate 64 before being threadedly received within its threaded opening 112. The baffle 110 is fastened in position by threaded screws 113 which are provided with suitable lock nuts and the threaded screws are accessible only from the inside of the dispensing machine 21 inasmuch as the mounting plate 25 with its baffle 110 is mounted flush against a wall defining the machine 21. The threaded screws 113 are threadedly received within threaded openings 114 in the mounting plate 25.

Thus, the side plates 64 are held in position in a fixed manner at opposite sides of the support body and the slider 27 has suitable slots at opposite sides thereof to enable unobstructed sliding reciprocation of such slider in the previously mentioned rectilinear path P.

The construction 20 has its upper leaf spring structure 74 suitably supported by the side plates 64. The structure 74 is a comb-like structure consisting of a plurality of leaf springs each designated by the same reference numeral 117 and the springs are supported in a cantilevered manner by a support member 120 (FIG. 13) which, in essence, has a bifolded forward portion 121 which receives the upstream end of the leaf springs 117 in sandwiched relation between the bifolded portion thereby clamping and holding the springs 117 in position and in equally spaced parallel relation. Each spring 117 cooperates with an associated lower spring member 86 as also taught in the above-mentioned patent to control the movement of and provide testing of an associated coin therebetween.

The member 120 also has an upstanding portion 122 (FIGS. 3 and 13) provided with a pair of the previously mentioned hooking members each defined as an L-shaped hooking member 52. In this example of the invention, one of the hooking members has the forward hooking end 51 of the tension spring 50 hooked thereabout in the manner previously described and for the purpose previously described. The member 120 has opposite ends thereof uniquely held in position by insertion thereof in a pair of slots 123 provided in the side plates 64. In this manner, the upper leaf spring structure 74 is held in position in a cantilevered manner by supporting the member 120 in associated slots 123 in the side plates 64.

As mentioned earlier, the construction 20 has a pair of pawls 102 which are provided for the purpose previously described. The pawls are spring loaded utilizing tension springs 103 and one end of each tension spring is fastened to its associated pawl by extending a portion thereof through an associated opening in the pawl provided for this purpose. Each tension spring 103 is fastened in position at its opposite end and thereby tensioned by looping a portion thereof around an associated hooking member 124 provided on a bar 128. The bar 128 has opposite end portions which are received within cooperating slots 129 in the side plates 64.

The construction 20 also has a roughly L-shaped member 130 which has one end 131 suitably received within a slot 132 in one of the plates 64 and has a long transverse arm portion 133 suitably received in a cooperating elongate slot 134 defined in an opposite side plate 64. The member 130 is provided for the purpose of supporting the individual springs 117 of the upper leaf spring structure 74 to assure and allow each coin engaging an associated spring 117 to pass therethrough in the event the coin engaged at the test station is found acceptable.

The construction 20 has means for providing movement of each coin away from and then back toward the previously described rectilinear path P during movement of the slider 27 from its inoperative position 30 to the test position. The baffle means 46 comprises previously mentioned baffle 110 which is detachably fastened to the mounting plate 25. The baffle 110 has what will be referred to as a first control surface 125 (FIG. 13) and the slider 27 has a second control surface 126 which is spaced a precise distance away from the first control surface to thereby allow the reciprocation of the slider 27 in an unobstructed manner. The precise distance referred to above between the first and second control surfaces is generally of the order of a few thousandths of an inch and it has been found that a spacing not exceeding four thousandths of an inch (0.004 inch) provides optimum results because it is very difficult to insert an effective tool in this small dimension.

The control surfaces 125 and 126 may have any suitable configuration; however, it is preferred that the control surfaces be defined by cooperating undulating or convoluted surfaces 125–126. Accordingly, the undulating surface 126 is such that it meshes precisely with the undulating surface 125 while allowing unobstructed reciprocation of the slider 27. Further, the utilization of undulating surfaces 125 and 126 makes it virtually impossible to insert even thin flat shims through the baffle means including the baffle plate 110 to cheat the construction 20. The surfaces 125–126 also prevent such shims from getting beyond the baffle 92 and to the area indicated at 75 in FIG. 5.

In this disclosure of the invention the slider 27 has been described as being provided with a plurality of elongate narrow pockets 33 each for receiving an associated coin and each as previously described. However, as described above, the second control surface or top surface 126 of slider 27 is an undulating surface and it will be appreciated that such surface is defined by alternating crests 130 and valleys or grooves 131, and as shown in FIG. 1. The elongate narrow pockets 33 are defined in the grooves 131.

The construction 20 utilizes unique means for adjusting, i.e. changing, the size for each elongate pocket 33 to accommodate coins of different sizes and valuation and such means will be referred to as pocket sizing means and designated generally by the reference numeral 133. The pocket sizing means 133 comprises a spring loaded plate 134 (FIG. 13) and a plurality of the previously mentioned adjustable bars 37 which are substantially identical. The plate 134 is detachably fastened to the bottom surface of the slider 27 by a threaded screw 136 which is received within a corresponding threaded opening provided in the slider 27. A compression spring 137 is disposed so that it acts between the inside surface of the plate 134 and the bottom surface of the slider 27 to yieldingly urge such plate outwardly and for a purpose which will be described subsequently. The spring loaded plate 134 is an L-shaped plate which has a main body portion and a leg 140 disposed transverse the main body portion with the leg adapted to be received within selected slots in each bar 37.

Each adjustable bar 37 is a roughly T-shaped bar having a transverse arm and an elongate leg 135. Each transverse arm has an outermost surface portion 36, which was previously described, and the surface portion 36 defines an end surface of an associated slot 33. As will be readily apparent from FIG. 13 of the drawings the leg 135 of each adjustable bar 37 has a plurality of slots therein and each slot is particularly adapted to have the leg 140 of the spring loaded plate 134 received therewithin so as to hold in position the associated bar along its pocket 33 and define the outermost surface portion of such pocket.

Figure 8:
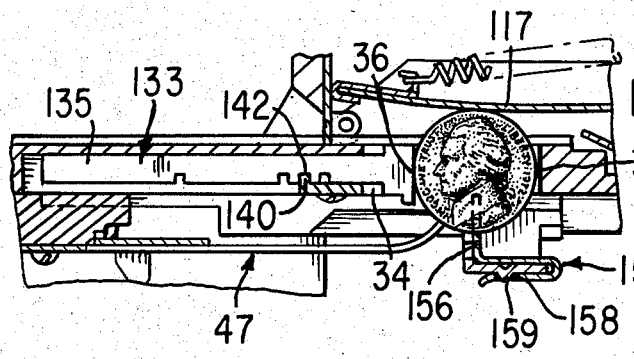
FIG. 8 is a fragmentary view similar to the central portion of FIG. 5 and taken essentially on the line 8—8 of FIG. 7 showing a five cent coin in its test position.

Accordingly, each bar 37 has an innermost slot 141 which will be referred to as its twenty-five cent slot, i.e., the slot associated with a twenty-five cent coin, slot 142 which will be referred to as its five cent slot, a slot 143 which will be referred to as its ten cent slot, and a slot 144 which will be referred to as its blanking slot. Thus, in the illustration of FIG. 5, for example, the twenty-five cent slot 141 is engaged by the leg 140 whereby the associated bar 37 is particularly adapted to be used with a twenty-five cent coin. In the illustration of FIG. 8 the five cent slot 142 is engaged by the leg 140 whereby the associated bar 37 is used with a five cent coin. Similarly, in the illustration of FIG. 9 the slot 143 is engaged by the leg 140 whereby the associated bar 37 is used with a ten cent coin. Finally, in the illustration of FIG. 10 it will be seen that the slot 144 is engaged by the leg 140 whereby the entire associated pocket 33 is blanked out.

The adjustable bars 37 are made so that the end surfaces 36 thereof are hardened end surfaces. It will be appreciated that in the normal operation of the construction 20 the adjustable bars 37 serve as pusher bars and the hardened surfaces are of such hardness that the serrations provided on various coins normally utilized in the construction 20 will not wear away such surfaces. Thus, the bars 37 may be considered as pusher bars having controlled hardness pusher surfaces 36.

In this example of the invention a plurality of eight pusher bars are utilized in association with the eight pockets provided in the slider 27. However, it is to be understood that the construction 20 may have any desired number of pockets and a corresponding number of pusher bars.

The pockets 33 as to number selected and size may be varied, as desired, to receive any desired combination of coins to provide the desired operation of the machine 21 and it is a simple matter to adjust the bars 37. Further, because of the manner in which the construction 20 is made each bar 37 may be slid and locked into position along its pocket 33 without removing same from the construction 20 and without removing the slide bar 27 from the housing. This is possible because of the easy accessibility of the underside of the slider and bars. Further, during adjustment of the bars 37 the spring-loaded plate 134 enables movement of such bars while keeping same assembled on the slider 27.

The bars 37 are preferably made of hard material such as steel, or the like, whereby the surfaces 36 thereof are hardened surfaces. However, it is to be understood that in some applications of this invention it may be desired to make only the transverse arms of the T-shaped bars 37 of hardened material or the surfaces 36 may be defined as plated, or otherwise treated surfaces, to provide the desired hardness for same.

Thus, it is seen that the bars 37 provide a unique and versatile means for adjusting the number of coins required to initiate one operation of the machine 21. Further, the use of bars 37 make it possible for an unskilled mechanic to change the number and total value of coins for each operation of construction 20 as the need arises.

It should be emphasized that the operation of the construction 20 is such that all coins are brought into the test position 40 in a simultaneous manner and the upper leaf spring structure 74 must be operated by all required genuine coins at the same time. Unless and until all required genuine coins are in the test position 40 it is impossible to move the slider 27 from its inoperative position to its fully advanced operative position. Thus, if even one coin is not of the required valuation and genuineness it will be impossible to advance the slider 27 to the operative position 31. The operation of the construction 20 in this respect regarding the requirement that all coins be of the required genuineness and valuation is essentially the same as described in the above-mentioned patent.

Figure 9:
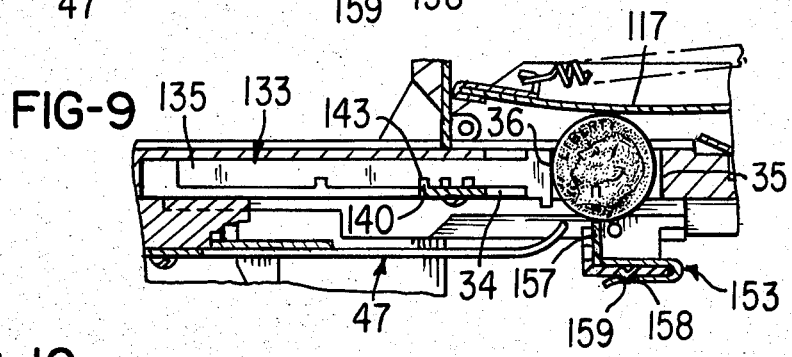
FIG. 9 is a fragmentary view similar to FIG. 8 and taken essentially on the line 9—9 of FIG. 7 showing a ten cent coin in its test position.
Figure 10:
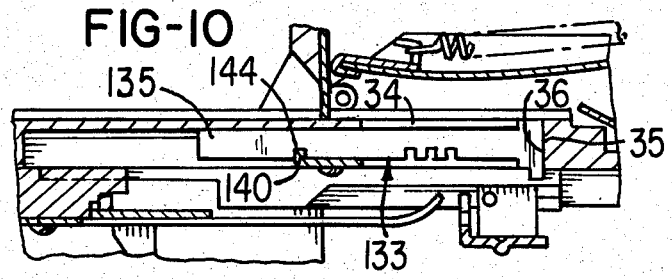
FIG. 10 is a view taken essentially on the line 10—10 of FIG. 7.

In this disclosure of the invention the various sizes of coins have been illustrated in FIGS. 5, 8 and 9 in the form of a twenty-five cent coin, five cent coin, and ten cent coin respectively. However, it will be appreciated that, if desired, a one cent coin may be utilized or a dollar coin if such becomes widely used. Further, the construction 20 lends itself to simple adjustments to accommodate coins of any country of the world.

In addition to the adjustable bars 37 described above, the construction 20 employs, at the test station 40, the previously mentioned coin gauge structure 82 which is a unique structure; and, the structure 82 is provided for accommodating coins of different sizes. The coin gauge structure comprises an L-shaped member 146 provided with integral side plates 147 and the member 146 is adapted to be fixed in position to the member 65 by threaded screws 150. The member 146 has an upstanding coin gauge arm 151 which is provided with precisely defined slots 152 having side surfaces which in this example are constructed and arranged to receive twenty-five cent coins therein so that with the member 146 fastened in position on the member 65 the surface means defining slots 152 are sized and arranged to receive twenty-five cent coins, provide precise gauging thereof, and allow passage of same through the test station 40.

However, in accordance with the teachings of this invention a plurality of L-shaped clips are provided for use in structure 82 and each clip is designated generally by the reference numeral 153, even though each may accommodate a different size coin. Each clip has a bifolded portion 154 which is identical to the bifolded portion of other clips and an upstanding portion which varies in length or extension depending on the size coin it is designed to gauge.

Thus, the upstanding portion for a five cent coin is designated by the reference numeral 156 in FIG. 8 and is of one dimension. The upstanding portion for a ten cent coin is designated by the reference numeral 157 in FIG. 9 and is longer than the upstanding portion 156. Each upstanding portion is tailored to the size of its associated coin. It will be appreciated that each upstanding portion is provided with associated surface means similar to the surface means 152 corresponding to its coin.

The clips 153 are easily installed in position on the member 146. In particular, each clip 153 is readily installed in position by a snap-fitting action and indeed each clip has an opening 158 therein in the bottom leg of its bifolded portion 154 which is adapted to receive therein a mating projection 159 extending from the underside of the member 146. Each clip 153 may be snap fitted in position by moving same into alignment over portion 146 with opposite members of the bifolded portion 154 on opposite surfaces of the member 146 and as indicated by the arrow in FIG. 13.

Figure 12:
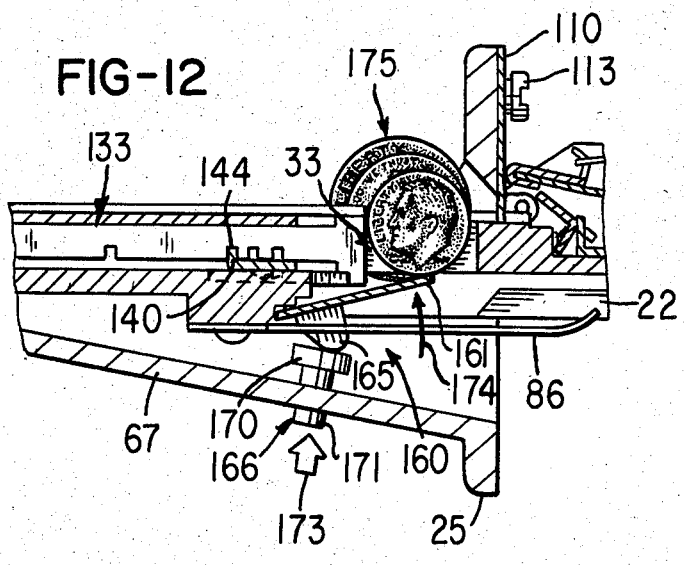
FIG. 12 is a view similar to FIG. 11 illustrating three coins in their associated pockets and further illustrating the operation of a coin inject mechanism.

The construction 20 has a unique coin eject mechanism or coin ejector which is designated generally by the reference numeral 160 which enables outward lifting of the coins inserted in associated pockets 33 (lifting vertically in this example) if a wrong size coin has been inadvertently placed in a pocket. The coin ejector 160 has a pivoted plate portion 161 which is pivoted by pivot members 162 received in associated slots 163 in the member 65. The plate 161 has a depending member 165 which extends beneath the bottom surface of its main body portion. A pusher button 166 is provided as a part of the coin ejector and the button 166 has a stem portion which is received within an opening 167 in the bottom wall 67 of the support member 54. The button 166 has a head 170 which limits the extent of downward movement thereof and the stem portion is a rod-like portion 171 which is freely movable within the opening 167. The pivoted member 161 is adapted to be moved upwardly by the head 170 engaging the depending portion 165 thereof upon being actuated manually by an operator desiring to retrieve a coin. In this manner it will be seen that coins provided in associated pockets 33 may be moved upwardly by applying of force as shown by the arrow 173 in FIG. 12 thereby urging the member 161 upwardly as shown by the arrow 174 whereby the coins are lifted as shown at 175 and easily grasped for removal from an associated pocket 33, if desired.

Figure 11:
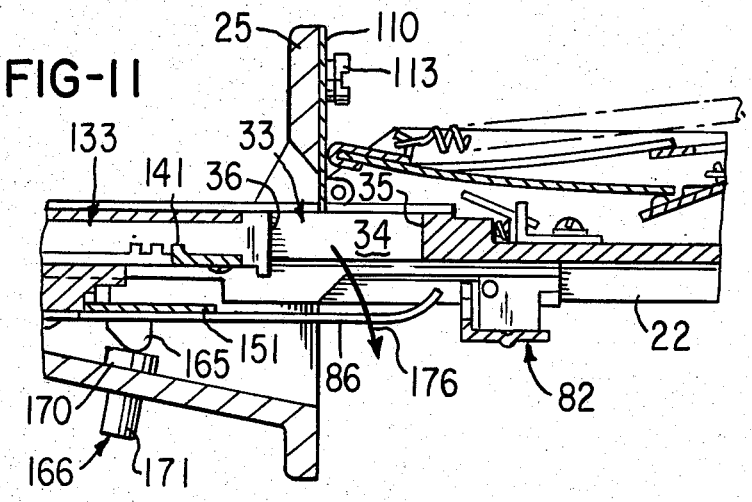
FIG. 11 is a view similar to the central portion of FIG. 3 with the coin removed and illustrating the manner in which foreign articles may be pushed through the slider of the coin chute construction in a harmless manner.

It will also be appreciated that the construction and arrangement of components of the construction 20 are such that putty, gum, toothpicks, paper, and the like which are shoved through the pocket 33 are easily moved between the teeth of the spring structure 47 and as shown by the arrow 176 in FIG. 11 also with the slider 27 in its retracted position such trash also tends to be moved between the end of the spring structure 42 and the structure at the test position 40.

In this disclosure of the invention it will be seen that the spring structure 42 acts as a grating having wider openings than the coin openings and thus make it self-cleaning of the trash, dirt and foreign objects in the manner mentioned. Also the gap between the ends of the springs of the spring structure and the structure at the test station serves the same function due to the space provided.

In the construction 20 the coins are gauged between the gauge bar and the upper set of leaf spring structure 74 as previously described. There is roughly an eight to one ratio of measurement which activates a stop common to all eight leaves of the spring structure. Further, in the event any one of these leaves of the spring structure is not properly actuated it is impossible to provide movement of the slider. In short, if one or more coins fails to pass the test at the test station the slider 27 is in a fully locked position whereby it cannot be advanced and the construction cannot be cheated.

It will also be appreciated that in this disclosure of the invention only one coin has been shown and utilized in association with an associated pocket. However, it is to be understood that a plurality of coins may be utilized in association with each pocket and as taught in the above-mentioned patent.

In this disclusure of the invention the pockets 33 are particularly adapted to receive coins edgewise and movement of such coins for testing is achieved with the coins thus arranged; however, it will be appreciated that the concept of employing means for providing movement of the coins away from and then back toward the rectilinear path P during movement of a coin slider of a coin chute construction is fully applicable to coins disposed in pockets which receive coins other than edgewise.

Terms such as top, bottom, inner, outer and like terms have been used in this disclosure to describe the operation of certain items as shown in the drawings; however, it is to be understood that these terms are not to be considered limiting in any way.

While present exemplary embodiments of this invention, and methods of prectising the same, have been illustrated and described, it will be recognized that this invention may be otherwise variously embodied and practiced within the scope of the following claims.

What is claimed is:

1. In a coin chute construction for a dispensing machine which requires at least one coin of predetermined size and valuation to initiate one operation of said machine for one item of goods or service, said construction comprising, a support body, a slider supported on said body for reciprocation in a rectilinear path between a fully retracted inoperative position and a fully advanced operative position thereof, at least one pocket in said slider for receiving said coin, said pocket being defined by surface means for supporting said coin so that upon moving said slider toward said operative position said coin is moved therewith to a test position and then toward said operative position, test means at said test position for testing said coin for acceptability as to valuation and genuineness and when acceptable allowing full movement of said slider to said operative position enabling said slider to initiate said one operation of said machine, means operative upon failure of said coin to satisfy the test provided by said test means at said test position to preclude said full movement to said operative position, and means for providing curvilinear movement of said coin away from and then back toward said rectilinear path during movement of said slider from said inoperative position to said test position, said providing means comprising baffle means and cooperating yieldable spring means, the improvement in which said spring means is a one-piece leaf spring member adapted to engage and provide the sole bottom support for said coin during said curvilinear movement and thereby assure precise introduction of said coin into said test means.

2. A construction as set forth in claim 1 in which said movement is in a vertical plane.

3. A construction as set forth in claim 1 in which said providing means and said curvilinear movement cooperate to prevent shims from being used effectively to bypass the function of said test means and said providing means also provides a self cleaning action of foreign objects urged against an outer surface of said slider to thereby reduce the likelihood of jamming of said slider during said reciprocation thereof.

4. A construction as set forth in claim 3 in which said pocket is a narrow elongate pocket and is defined by surface means supporting said coin edgewise.

5. A construction as set forth in claim 3 in which said support body comprises a mounting plate, said baffle means comprises a baffle detachably fastened to said mounting plate and having a first control surface, and said slider comprises a second control surface spaced a precise close distance away from said first control surface while still allowing unobstructed reciprocation of said slider.

6. A construction as set forth in claim 1 and further comprising a coin ejector for lifting out of said pocket a coin desired to be removed therefrom.

7. A construction as set forth in claim 6 in which said coin ejector comprises a pivoted plate portion which is pivoted on said body and a button supported on said body, said button being adapted to be pushed upwardly by an operator to thereby push said plate which in turn lifts said coin out of said pocket for easy manual grasping.

8. A construction as set forth in claim 7 in which said button has a rod-like portion received within an opening in said body and a head which limits the extent of movement of the button in one direction while being adapted to engage and push said plate to thereby lift said coin.

9. A construction as set forth in claim 1 and further comprising a coin gauge structure at said test station for accommodating coins of different sizes.

10. A construction as set forth in claim 9 in which said coin gauge structure comprises a support member adapted to have clips detachably fastened thereto, each clip being adapted to support an associated coin of different size and valuation.

11. A construction as set forth in claim 1 and further comprising pocket sizing means for changing the size of said pocket to accommodate coins of different size and valuation.

12. A construction as set forth in claim 11 in which said pocket sizing means comprises an adjustable pusher bar for varying at least one dimension of said pocket and means for fastening said bar to said slider to provide for varying said one dimension.

13. In a coin chute construction for a dispensing machine which requires at least one coin of predetermined size and valuation to initiate one operation of said machine for one item of goods or service, said construction comprising, a support body, a slider supported on said body for reciprocation in a rectilinear path between a fully retracted inoperative position and a fully advanced operative position thereof, at least one pocket in said slider for receiving said coin, said pocket being defined by surface means for supporting said coin so that upon moving said slider toward said operative position said coin is moved therewith to a test position and then toward said operative position, test means at said test position for testing said coin for acceptability as to valuation and genuineness and when acceptable allowing full movement of said slider to said operative position enabling said slider to initiate said one operation of said machine, means operative upon failure of said coin to satisfy the test provided by said test means at said test position to preclude said full movement to said operative position, and means for providing curvilinear movement of said coin away from and then back toward said rectilinear path during movement of said slider from said inoperative position to said test position, said providing means comprising baffle means and cooperating yieldable spring means, said providing means and said curvilinear movement cooperating to prevent shims from being used effectively to bypass the function of said test means and said providing means also providing a self cleaning action of foreign objects urged against an outer surface of said slider to thereby reduce the likelihood of jamming of said slider during said reciprocation thereof, said support body comprising a mounting plate, said baffle means comprising a baffle detachably fastened to said mounting plate and having a first control surface, said slider comprising a second control surface spaced a precise close distance away from said first control surface while still allowing unobstructed reciprocation of said slider, and said spring means being a leaf spring having one end thereof fastened to said support body in a cantilevered manner, the improvement in which said spring is a metal leaf spring having a straight upstream portion provided with a hole therein and an upwardly curved downstream portion, said hole being adapted to receive a fastening screw for fastening said leaf spring to said support body and said upwardly curved downstream portion being adapted to introduce said coin into said test means.

14. A construction as set forth in claim 13 in which said first control surface is a first undulating surface and said second control surface is a second undulating surface which meshes precisely with said first undulating surface, said undulating surfaces serving to prevent use of said shims.

15. A construction as set forth in claim 14 in which said second control surface is defined by alternating crests and grooves and said pocket is defined in an associated groove.

16. In a coin chute construction for a dispensing machine which requires at least one coin of predetermined size and valuation to initiate one operation of said machine for one item of goods or service, said construction comprising, a support body, a slider supported on said body for reciprocation in a rectilinear path between a fully retracted inoperative position and a fully advanced operative position thereof, at least one pocket in said slider for receiving said coin, said pocket being defined by surface means for supporting said coin so that upon moving said slider toward said operative position said coin is moved therewith to a test position and then toward said operative position, test means at said test position for testing said coin for acceptability as to valuation and genuineness and when acceptable allowing full movement of said slider to said operative position enabling said slider to initiate said one operation of said machine, means operative upon failure to said coin to satisfy the test provided by said test means at said test position to preclude said full movement to said operative position, means for providing curvilinear movement of said coin away from and then back toward said rectilinear path during movement of said slider from said inoperative position to said test position, pocket sizing means for changing the size of said pocket to accommodate coins of different size and valuation, said pocket sizing means comprising an adjustable pusher bar for varying at least one dimension of said pocket, and means for fastening said bar to said slider to provide for varying said one dimension, the improvement in which said bar is a roughly T-shaped bar, said bar having a transverse arm portion provided with an outermost surface which comprises a part of said surface means and serves as a pusher surface for said coin upon moving said slider toward said operative position, said bar having a leg portion provided with a plurality of slots therein, certain of said slots being placed along said leg based on the valuation and size of an associated coin to be used therewith enabling a portion of said fastening means to be placed in an associated slot to position said bar at the desired position along said pocket.

17. In a coin chute construction for a dispensing machine which requires a plurality of coins of predetermined size and valuation to initiate one operation of said machine for one item of goods or service, said construction comprising, a support body, a slider supported on said body for reciprocation in a rectilinear path between a fully retracted inoperative position and a fully advanced operative position thereof, a plurality of pockets in said slider for receiving said coins, each of said pockets being defined by surface means for supporting its coin so that upon moving said slider toward said operative position its coin is moved therewith to a test position and then toward said operative position, test means at said test position for testing said coins for acceptability as to valuation and genuineness and when all coins are acceptable allowing full movement of said slider to said operative position enabling said slider to initiate said one operation of said machine, means operative upon failure of all coins to satisfy the test provided by said test means at said test position to preclude said full movement to said operative position, and means for providing curvilinear movement of all coins away from and then back toward said rectilinear path during movement of said slider from said inoperative position to said test position, said providing means comprising baffle means and cooperating yieldable spring means, the improvement in which said spring means is a one-piece leaf spring member adapted to engage and provide the sole bottom support for said coins during said curvilinear movement and thereby assure precise introduction of said coins into said test means.

18. A construction as set forth in claim 17 in which said providing means and said curvilinear movement cooperate to prevent shims from being used effectively to bypass the function of said test means and said providing means also provides a self cleaning action of foreign objects urged against an outer surface of said slider to thereby reduce the likelihood of jamming of said slider during said reciprocation thereof.

19. A construction as set forth in claim 18 in which said support body comprises a mounting plate, said baffle means comprises a baffle detachably fastened to said mounting plate and having a first control surface, and said slider comprises a second control surface spaced a precise close distance away from said first control surface while still allowing unobstructed reciprocation of said slider.

20. A construction as set forth in claim 19 in which said first control surface is a first undulating surface and said second control surface is a second undulating surface which meshes precisely with said first undulating surface, said undulating surfaces serving to prevent use of said shims.

21. A construction as set forth in claim 20 in which said second control surface is defined by alternating crests and grooves and said pockets are defined in said grooves.

22. A construction as set forth in claim 21 and further comprising a coin ejector for lifting said coins out of said pockets to enable removal of any coin from its associated pocket.

23. A construction as set forth in claim 21 and further comprising a coin gauge structure at said test station for accommodating coins of different sizes.

24. A construction as set forth in claim 23 in which said coin gauge structure comprises an L-shaped member and a plurality of clips detachably fastened thereto each of said clips being adapted to support an associated coin thereon.

25. A construction as set forth in claim 24 in which each clip is an L-shaped clip which has a bifolded portion snap-fitted on a part of said L-shaped member and an upstanding portion which is provided with associated surface means to accommodate an associated coin thereagainst.

26. A construction as set forth in claim 17 and further comprising pocket sizing means for changing the size of each of said pockets to accommodate coins of different size and valuation.

27. A construction as set forth in claim 26 in which said pocket sizing means comprises a plurality of pusher bars, each of said bars being adapted to vary at least one dimension of an associated pocket and means for fastening each bar to said slider to provide for varying its associated one dimension, and each of said bars also being adapted to blank out an entire pocket.

28. In a coin chute construction for a dispensing machine which requires a plurality of coins of predetermined size and valuation to initiate one operation of said machine for one item of goods or service, said construction comprising, a support body, a slider supported on said body for reciprocation in a rectilinear path between a fully retracted inoperative position and a fully advanced operation position thereof, a plurality of pockets in said slider for receiving said coins, each of said pockets being defined by surface means for supporting its coin so that upon moving said slider toward said operative position its coin is moved therewith to a test position and then toward said operative position, test means at said test position for testing said coins for acceptability as to valuation and genuineness and when all coins are acceptable allowing full movement of said slider to said operative position enabling said slider to initiate said one operation of said machine, means operative upon failure of all coins to satisfy the test provided by said test means at said test position to preclude said full movement to said operative position, means for providing curvilinear movement of all coins away from and then back toward said rectilinear path during movement of said slider from said inoperative position to said test position, pocket sizing means for changing the size of each of said pockets to accommodate coins of different size and valuation, said pocket sizing means comprising a plurality of pusher bars, each of said bars being adapted to vary at least one dimension of an associated pocket, and means for fastening each bar to said slider to provide for varying its associated one dimension, each of said bars also being adapted to blank out an entire pocket, the improvement in which each bar is a roughly T-shaped bar, each bar having a transverse arm portion provided with an outermost surface which comprises a part of said surface means and serves as a pusher surface for an associated coin upon moving said slider toward said operative position, each bar having a leg portion provided with a plurality of slots therein, certain of said slots being placed along said leg based on the valuation and size of an associated coin to be used therewith and one of said slots being a blanking slot, and said slots enabling a portion of said fastening means to be placed in an associated slot to position said bar at the desired position along its pocket.

29. In a method of making a coin chute construction for a dispensing machine which requires a plurality of coins of predetermined size and valuation to initiate one operation of said machine for one item of goods or service, said method comprising the steps of, providing a support body, supporting a slider on said body for reciprocation in a rectilinear path between a fully retracted inoperative position and a fully advanced operative position thereof, forming a plurality of pockets in said slider for receiving said coins, each of said pockets being defined by surface means for supporting its coin so that upon moving said slider toward said operative position its coin is moved therewith to a test position and then toward said operative position, providing test means at said test position for testing said coins for acceptability as to valuation and genuineness and when all coins are acceptable allowing full movement of said slider to said operative position enabling said slider to initiate said one operation of said machine, providing means operative upon failure of all coins to satisfy the test provided by said test means at said test position to preclude said full movement to said operative position, and providing means for providing curvilinear movement of all coins away from and then back toward said rectilinear path during movement of said slider from said inoperative position to said test position, said step of providing means for providing curvilinear movement comprising the steps of providing baffle means and providing cooperating yieldable spring means, the improvement in which said step of providing cooperating yieldable spring means comprises providing yieldable spring means in the form of a one-piece leaf spring member adapted to engage and provide the sole bottom support for said coins during said curvilinear movement and thereby assure precise introduction of said coins into said test means.

* * * * *